US011116285B2

(12) United States Patent
Ferrantello et al.

(10) Patent No.: US 11,116,285 B2
(45) Date of Patent: Sep. 14, 2021

(54) FOOTWEAR RETENTION SYSTEM

(71) Applicant: SHOESPENDER INC., Woodbury, NY (US)

(72) Inventors: Danielle Ferrantello, Cold Spring Harbor, NY (US); Frank Ferrantello, Cold Spring Harbor, NY (US)

(73) Assignee: Shoespender Inc., Woodbury, NY (US)

( * ) Notice: Subject to any disclaimer, the term of this patent is extended or adjusted under 35 U.S.C. 154(b) by 0 days.

(21) Appl. No.: 17/220,396

(22) Filed: Apr. 1, 2021

(65) Prior Publication Data

US 2021/0219665 A1 Jul. 22, 2021

Related U.S. Application Data

(63) Continuation-in-part of application No. 16/363,377, filed on Mar. 25, 2019.

(Continued)

(51) Int. Cl.
*A43C 11/00* (2006.01)
*A43B 23/28* (2006.01)

(Continued)

(52) U.S. Cl.
CPC ..... *A43B 23/28* (2013.01); *A41F 11/00* (2013.01); *A43C 11/06* (2013.01)

(58) Field of Classification Search
CPC ..... A45F 2005/006; A45F 2005/008; A41F 17/04; A41F 13/00; A41F 18/00; A43C 11/00; A41B 11/00; A41B 11/10; A41B 11/125; A43B 3/18; A43B 11/00; A43B 3/30

(Continued)

(56) References Cited

U.S. PATENT DOCUMENTS 1,412,033 A 4/1922 Able
2,238,804 A * 4/1941 Brown ..... A41B 11/10 36/10

(Continued)

OTHER PUBLICATIONS

Ames Research Center, "Advances in Measurement of Skin Friction in Airflow," retrieved from https://www.techbriefs.com/component/content/article/tb/pub/techbriefs/test-and-measurement/825#:~:text=The%20surface%20interferometric%20skin-friction%20(SISF)%20measurement%20system%20is,shear%20stress%20(skin%20friction)%20on%20a%20wind-tunnel%20model., last visited Mar. 30, 2021, 2 pages.

(Continued)

*Primary Examiner* — Adam J Waggenspack
(74) *Attorney, Agent, or Firm* — Headland Law & Strategy; Matthew J. Smyth

(57) ABSTRACT

In some embodiments, a footwear ensemble includes (i) a pair of socks, (ii) a pair of press-snap fasteners, (iii) a pair of shoes, and (iv) a pair of tethers. The pair of socks may include a first sock and a second sock, each of which may have a toe compartment and a leg opening opposite the toe compartment. The pair of press-snap fasteners may include a first press-snap connector and a second press-snap connector, each of which may be interchangeable and include a cap/socket portion and a stud/eyelet portion. The pair of tethers may include a first tether and a second tether, each of which may have an anchor end and a retention end. The retention end may include a shoe-retaining mechanism that is configured to releasably secure a shoe in the pair of shoes.

20 Claims, 10 Drawing Sheets

Related U.S. Application Data

(60) Provisional application No. 62/648,514, filed on Mar. 27, 2018.

(51) Int. Cl.
*A43C 11/06* (2006.01)
*A41F 11/00* (2006.01)

(58) Field of Classification Search
USPC ..... 224/220
See application file for complete search history.

(56) References Cited

U.S. PATENT DOCUMENTS 2,596,112 A * 5/1952 Aines ..... A41D 1/06 2/232
4,169,324 A 10/1979 Gibbs
4,187,619 A * 2/1980 Gibbs ..... A43B 17/18 2/240
5,038,413 A 8/1991 Ursino
5,082,156 A 1/1992 Braun
5,425,485 A 6/1995 Carlo
5,579,541 A 12/1996 Christy et al.
5,740,558 A 4/1998 Messman
5,908,206 A 6/1999 Lopresti, Jr.
5,918,318 A 7/1999 Jones
6,032,294 A * 3/2000 Dean ..... A41B 11/002 2/239
6,161,314 A * 12/2000 Kamrin ..... A43B 3/30 24/115 H
6,247,183 B1 6/2001 Haas-Laursen
6,393,619 B1 5/2002 Bardes
6,701,582 B1 3/2004 Milburn
6,708,342 B2 3/2004 Boersema
7,346,935 B1 * 3/2008 Patterson ..... A41B 11/004 2/239
8,359,671 B1 * 1/2013 Glass ..... D06F 95/008 2/239
8,544,300 B2 * 10/2013 Kaneda ..... D04B 1/108 66/186
D779,809 S 2/2017 Sorby et al.
10,117,475 B2 * 11/2018 Cassell ..... A41F 13/00
2004/0154075 A1 8/2004 Ferguson
2006/0248748 A1 11/2006 Warren
2007/0074429 A1 * 4/2007 McKay ..... A43B 3/30 36/136
2007/0192998 A1 * 8/2007 Ryder ..... A41F 17/02 24/1
2008/0196212 A1 8/2008 Nelson et al.
2012/0267403 A1 10/2012 Ward, Jr.
2015/0342262 A1 * 12/2015 Meinecke ..... A43B 17/18 2/240
2016/0198790 A1 * 7/2016 Ishmael ..... A41D 13/06 2/239
2016/0235148 A1 * 8/2016 Tadysak ..... A43B 23/02
2018/0325189 A1 * 11/2018 Stallbaum ..... A41D 1/08
2020/0237023 A1 * 7/2020 Miller ..... A43B 23/28

OTHER PUBLICATIONS

Bamboo Bubby, "Bamboo Fabric Research," retrieved from https://www.bamboobubby.com.au/bamboo-fabric-research/, last visited Mar. 30, 2021, 4 pages.
Cheung, "Human skin and underlying soft tissue," retrieved from https://www.sciencedirect.com/topics/engineering/frictional-property, last visited Mar. 30, 2021, 18 pages.
Electrotek, "KSE-SE Friction Tester," retrieved from http://electrotekintl.com/kes-se-friction-tester/#:~:text-KES-SE%20Friction%20Tester%20The%20KES-SE%20Friction%20Tester%20analyzes,more%20enhanced%20versatility%20over%20the%20KES-FB4-A%20Surface%20Tester., last visited Mar. 30, 2021, 3 pages.
Heskins, "What is Coefficient of Friction? And How To Measure It," retrieved from https://www.heskins.com/what-is-coefficient-of-friction-and-how-to-measure, last visited Mar. 30, 2021, 5 pages.
I Like Big Buttons, "Socks with KAM Snaps," retrieved from https://ilikebigbuttons.com/pages/socks-with-kam-snaps, last visited Feb. 26, 2021, 2 pages.
Inoue, "Surface Friction Properties of Fabrics and Human Skin," retrieved from https://cdn.intechopen.com/pdfs/15598/InTech-Surface_friction_properties_of_fabrics_and_human_skin.pdf, last visited Mar. 30, 2021, 10 pages.
Zhang et al., "In vivo friction properties of human skin," Prosthetics and Orthotics International 1999, 23: 135-141, 7 pages.

* cited by examiner

FOOTWEAR RETENTION SYSTEM

CROSS-REFERENCE TO RELATED APPLICATIONS

This application is a continuation-in-part of U.S. patent application Ser. No. 16/363,377, titled "FOOTWEAR RETENTION SYSTEM," filed on Mar. 25, 2019, which claims priority to U.S. Provisional Application Ser. No. 62/648,514, titled "DEVICE FOR SECURING FOOTWEAR TO CHILD'S ANKLE," filed on Mar. 27, 2018. This application incorporates the entire contents of the foregoing applications herein by reference.

TECHNICAL FIELD

Various embodiments relate generally to footwear, and more particularly to a retention system including a device for preventing the loss of footwear.

BACKGROUND

Footwear, such as, for example, shoes and sneakers, have a tendency for falling off the foot of a baby, infant, or small child during use and/or when the baby, infant, or small child is being carried or transported by an adult. Such footwear that falls off may be lost.

SUMMARY

In some embodiments, a footwear ensemble includes a pair of socks comprising a first sock and a second sock, each of the first sock and second sock having a toe compartment and a leg opening opposite the toe compartment. The footwear ensemble may include a plurality of nubs disposed on an interior surface of the first sock adjacent its leg opening and on an interior surface of the second sock adjacent its leg opening. The footwear ensemble may also include a pair of press-snap fasteners comprising a first press-snap connector and a second press-snap connector. Each of the first press-snap connector and second press-snap connector may be interchangeable and may include a cap/socket portion and a stud/eyelet portion. The footwear ensemble may further include a pair of tethers comprising a first tether and a second tether. Each of the first tether and second tether may have an anchor end and a retention end, and the retention end may have a shoe-retaining mechanism. The cap/socket portion of the first press-snap connector may be disposed on the first sock adjacent its leg opening, the stud/eyelet portion of the first press-snap connector may be disposed on the second sock adjacent its leg opening, the stud/eyelet portion of the second press-snap connector may be disposed on the first tether at its anchor end, and the cap/socket portion of the second press-snap connector may be disposed on the second tether at its anchor end.

In some embodiments, the plurality of nubs are silicone nubs. Each nub in the plurality of nubs may have a diameter that is less than 10 millimeters. Each nub in the plurality of nubs may extend no farther beyond an interior surface of a sock than 200% of a thickness of either sock in the pair of socks.

In some embodiments, a coefficient of friction of a nub in the plurality of nubs is at least 50% greater than a coefficient of friction of a material comprising the pair of socks.

The first sock and second sock may each further include an ankle compartment between the leg opening and the toe compartment. A second plurality of nubs comprising the same material as the plurality of nubs may be disposed on bottom portions of the toe compartment and ankle compartment.

The footwear ensemble may further include a pair of shoes having a first a shoe and a second shoe. The shoe-retaining mechanism may be configured to releasably secure a tether from the first tether or second tether to a shoe from the first shoe or second shoe.

In some embodiments, a footwear ensemble includes a pair of socks comprising a first sock and a second sock. Each of the first sock and second sock may have a toe compartment and a leg opening opposite the toe compartment. The footwear ensemble may further include a pair of press-snap fasteners comprising a first press-snap connector and a second press-snap connector. Each of the first press-snap connector and second press-snap connector may be interchangeable and may include a cap/socket portion and a stud/eyelet portion. The footwear ensemble may further include a pair of tethers having a first tether and a second tether. Each of the first tether and second tether may include an anchor end and a retention end. The retention end may include a shoe-retaining mechanism. The cap/socket portion of the first press-snap connector may be disposed on the first sock adjacent its leg opening, the stud/eyelet portion of the first press-snap connector may be disposed on the second sock adjacent its leg opening, the cap/socket portion of the second press-snap connector may be disposed on the second tether at its anchor end, and the stud/eyelet portion of the second press-snap connector may be disposed on the first tether at its anchor end. The footwear ensemble may further include a pair of shoes.

The pair of press-snap connectors may be disposed on the first sock, second sock, first tether, and second tether to facilitate joining the first sock and second sock, the first tether and second tether, the first tether and first sock, or the second tether and second sock.

In some embodiments, the shoe-retaining mechanism includes a spring-loaded jaw clip. In some embodiments, the shoe-retaining mechanism includes a clasp and loop.

The first sock and second sock may each include a plurality of nubs on an interior surface, adjacent their respective leg openings. The plurality of nubs may comprise silicone, rubber, foamed rubber or a synthetic resin. In some embodiments, each nub in the plurality of nubs extends no farther beyond an interior surface of a sock than 200% of a thickness of either sock in the pair of socks.

The first sock and second sock may each further include an ankle compartment between the leg opening and the toe compartment. A second plurality of nubs comprising the same material as the plurality of nubs may be disposed on bottom portions of the toe compartment and ankle compartment.

In some embodiments, a footwear ensemble includes (i) a pair of socks, (ii) a pair of press-snap fasteners, (iii) a pair of shoes, and (iv) a pair of tethers. The pair of socks may include a first sock and a second sock, each of which may have a toe compartment and a leg opening opposite the toe compartment. The pair of press-snap fasteners may include a first press-snap connector and a second press-snap connector, each of which may be interchangeable and include a cap/socket portion and a stud/eyelet portion. The pair of tethers may include a first tether and a second tether, each of which may have an anchor end and a retention end. The retention end may include a shoe-retaining mechanism that is configured to releasably secure a shoe in the pair of shoes.

In some embodiments, a cap/socket portion of the first press-snap connector is disposed on the first sock adjacent its leg opening, the stud/eyelet portion of the first press-snap connector is disposed on the second sock adjacent its leg opening, the cap/socket portion of the second press-snap connector is disposed on the second tether at its anchor end, and the stud/eyelet portion of the second press-snap connector is disposed on the first tether at its anchor end.

BRIEF DESCRIPTION OF THE DRAWINGS

Like reference numerals indicate similar parts throughout the figures.

DETAILED DESCRIPTION

Figure 1:
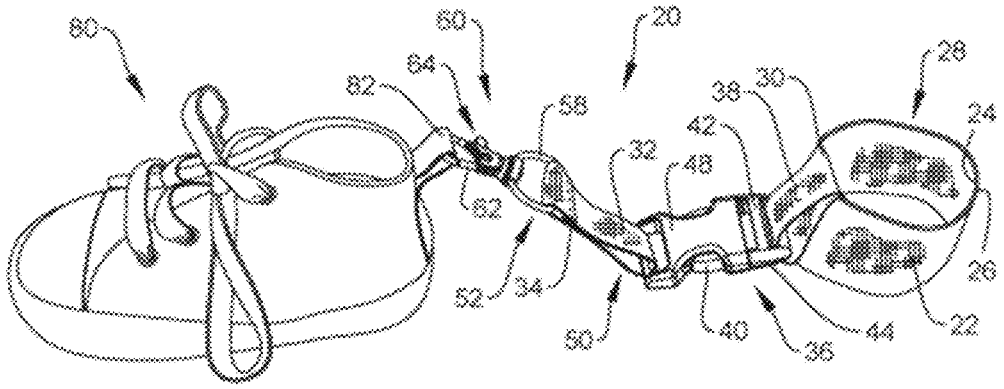
FIG. 1 illustrates an exemplary retaining system in accordance with the principles of the present disclosure.

The present disclosure may be understood more readily by reference to the following detailed description of the disclosure taken in connection with the accompanying drawing figures, which form a part of this disclosure. It is to be understood that this disclosure is not limited to the specific devices, conditions or parameters described and/or shown herein, and that the terminology used herein is for the purpose of describing particular embodiments by way of example only and is not intended to be limiting of the claimed disclosure.

Also, as used in the specification and including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment. It is also understood that all spatial references, such as, for example, horizontal, vertical, top, upper, lower, bottom, left and right, are for illustrative purposes only and can be varied within the scope of the disclosure. For example, the references "upper" and "lower" or "top" and "bottom" are relative and used only in the context to the other and are not necessarily "superior" and "inferior".

The following discussion includes a description of a system that includes a retention device for preventing the loss of footwear, in accordance with the principles of the present disclosure. Alternate embodiments are also disclosed. Reference will now be made in detail to the exemplary embodiments of the present disclosure, which are illustrated in the accompanying figures. Turning to FIGS. 1-13, there are illustrated a retaining system 20.

Retaining system 20 comprises a strap 22 including a first end 24 and an opposite second end 26. Strap 22 extends continuously from end 24 to end 26. End 26 is permanently connected to and/or joined with end 24 to define a loop 28. Loop 28 is configured to be positioned around an anchor, such as, for example, a child's leg or other limb to couple an article of footwear, for example, to strap 22 to prevent inadvertent loss of the article of footwear, as discussed herein. In order for loop 28 to be effective in preventing inadvertent loss of the article of footwear, loop 28 should not be able to be broken such that end 24 is separated from end 26 for example. Indeed, if loop 28 was capable of being broken such that end 24 is separated from end 26, strap 22 would fall off its anchor (e.g., child's leg) and an article of footwear, for example, that is coupled to strap 22 would be lost. In some embodiments, strap 22 comprises an elastic material to allow loop 28 to expand from a resting state when being positioned over a child's leg, for example, and then contract and return to the resting state when loop 28 is in the desired location along the child's leg. In some embodiments, strap 22 comprises an elastic material that includes a class of polymer materials with high elastic nature including, but not limited to, natural rubber, synthetic rubber, nitrile rubber, silicone rubber, urethane rubbers, chloroprene rubber, Ethylene Vinyl Acetate (EVA rubber), nylon, polyester and spandex and combinations thereof.

In some embodiments, loop 28 is produced by circular knitting. In some embodiments, the circular knitting process includes circularly knitting yarn or other material into a fabric, such as, for example, a performance fabric. Circular knitting may include organizing knitting needles into a circular knitting bed. A cylinder may rotate and/or interact with a cam to move the needles reciprocally for knitting action. The yarns or other materials to be knitted are fed from packages to a carrier plate that directs strands of the yarn or other material(s) to the needles. In this manner, the knitting needles produce a circular fabric that is in a tubular form through the center of the cylinder. The circular fabric is then cut to produce loop 28 such that loop 28 has a square or rectangular shape. This allows loop 28 to be formed from a single, continuous piece of fabric that is produced using circular knitting. As such, loop 28 extends from end 24 to end 26 without including any seams between end 24 and end 26. In some embodiments, end 26 is permanently connected and/or joined with end 24 such that end 26 cannot be disconnected from end 24 without breaking end 24 and/or end 26. In some embodiments, end 26 is integrally and/or monolithically formed with end 24. In some embodiments, end 26 is coupled to end 24 by Velcro, threads, mutual grooves, screws, adhesive, nails, barbs, raised elements, spikes, clips, snaps, friction fittings, compressive fittings, expanding rivets, staples, fixation plates, key/keyslot, tongue in groove, dovetail, magnetic connection and/or posts.

Figure 4:
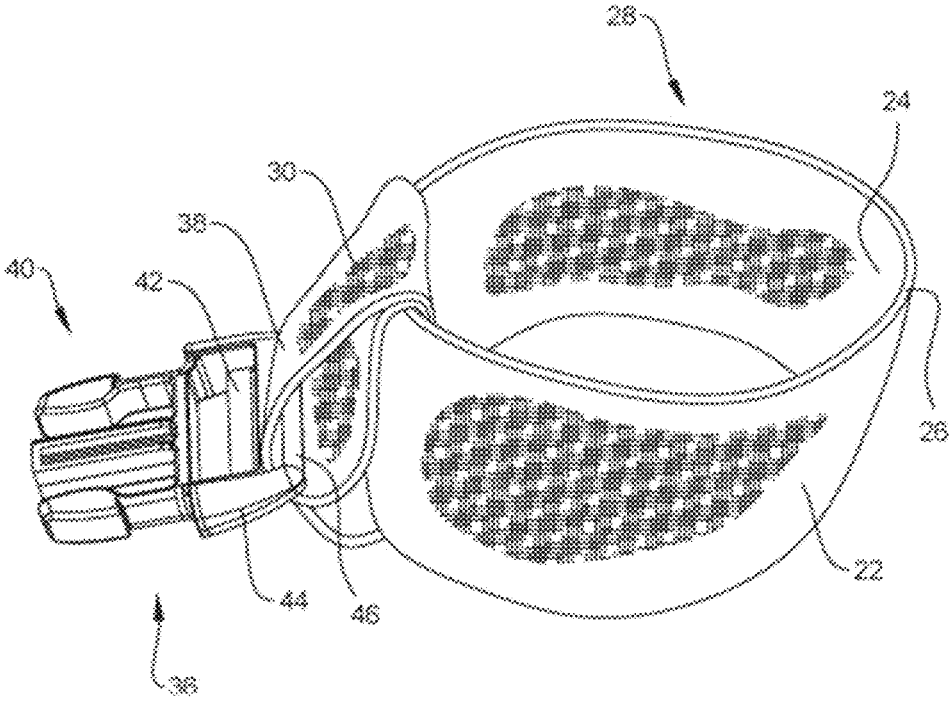
FIG. 4 illustrates components of the exemplary retaining system of FIG. 1.
Figure 5:
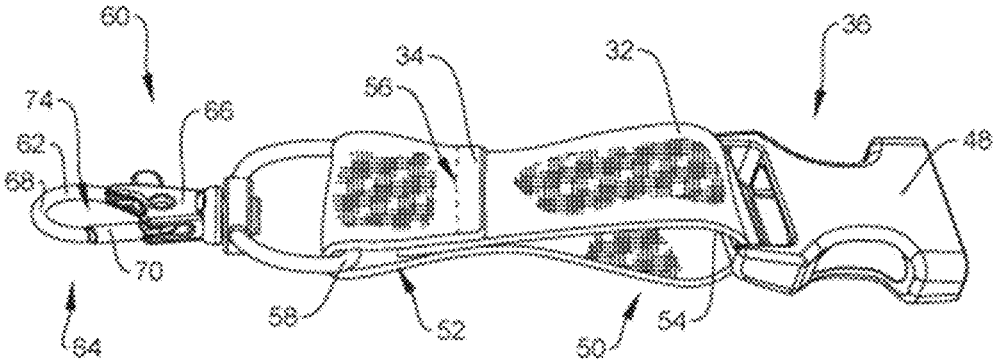
FIG. 5 illustrates components of the exemplary retaining system of FIG. 1.

In some embodiments, loop 28 is coupled to an end 30 of a tether 32. In some embodiments, end 30 is directly coupled to an opposite end 34 of tether 32. That is, tether 32 is continuous from end 30 to end 34. In some embodiments, end 30 is coupled end 34 by a connector 36. End 30 comprises a band 38 that is coupled to loop 28. An end 40 of connector 36 is coupled to band 38. In some embodiments, end 40 defines a male component of connector 36, as discussed herein. In some embodiments, end 40 includes a body having a first side 42 that is connected to a second side 44 by a shaft 46. Shaft 46 is positioned within band 38 such that band 38 surrounds shaft 46 to couple end 40 to end 30, as best shown in FIG. 4. In some embodiments, end 30 is coupled to loop 28 by stitching that extends through end 30 and/or loop 28. In some embodiments, end 30 is coupled to loop 28 by Velcro, threads, mutual grooves, screws, adhesive, nails, barbs, raised elements, spikes, clips, snaps, friction fittings, compressive fittings, expanding rivets, staples, fixation plates, key/keyslot, tongue in groove, dovetail, magnetic connection and/or posts. In some embodiments, end 30 is integrally and/or monolithically formed with loop 28.

Figure 2:
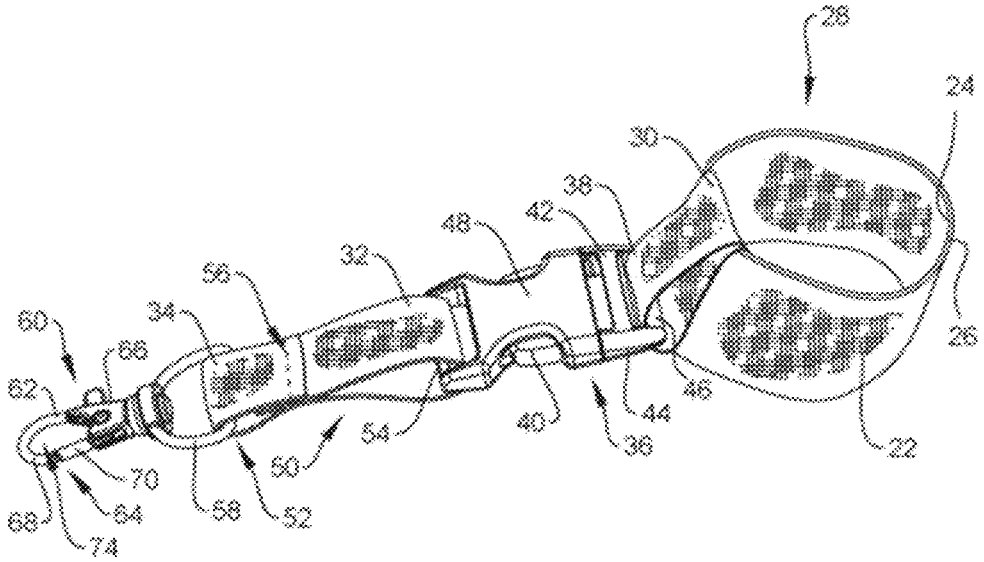
FIG. 2 illustrates components of the exemplary retaining system of FIG. 1.
Figure 3:
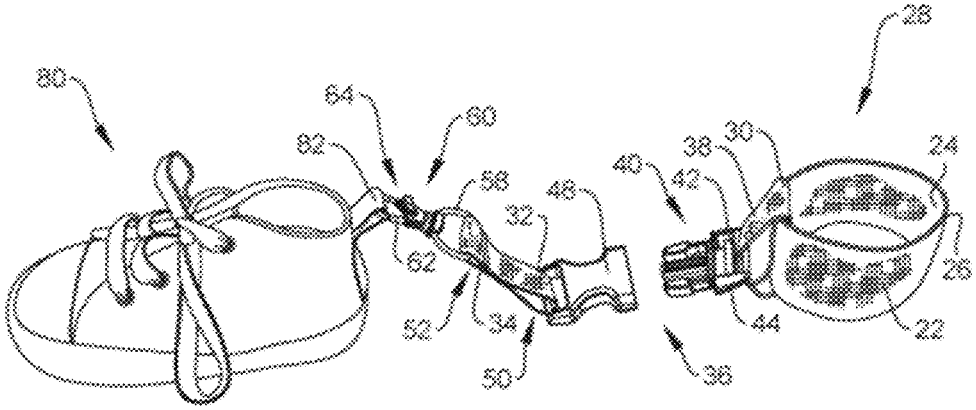
FIG. 3 illustrates components of the exemplary retaining system of FIG. 1.

An end 48 of connector 36 is coupled to end 34. In some embodiments, end 48 defines a female component of connector 36 that is configured to receive end 40 to couple end 48 to end 40, as discussed herein. End 34 of tether 32 defines a first hoop 50 and a second hoop 52. A shaft 54 of end 48 is positioned within hoop 50 such that hoop 50 surrounds shaft 54 to couple end 34 to end 48. In some embodiments, hoops 50, 52 are formed by taking a strip of material and connecting opposite ends of the strip of material by stitching 56 such that stitching 56 extends through the strip of material at least twice. Connector 36 is movable between a first orientation in which end 30 of tether 32 is connected to end 34 of tether 32 by connector 36, as shown in FIGS. 1 and 2, and a second orientation in which end 30 is not connected to end 34 by connector 36, as shown in FIG. 3. In some embodiments, the orientation of ends 40, 48 is reversed such that end 40 is coupled to end 34 of tether 32 and end 48 is coupled to end 30 of tether 32. In some embodiments, connector 36 is a side release buckle fastener.

Figure 6:
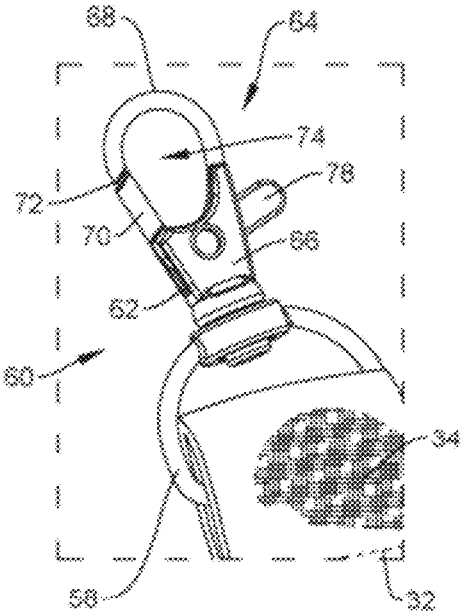
FIG. 6 illustrates components of the exemplary retaining system of FIG. 1.
Figure 7:
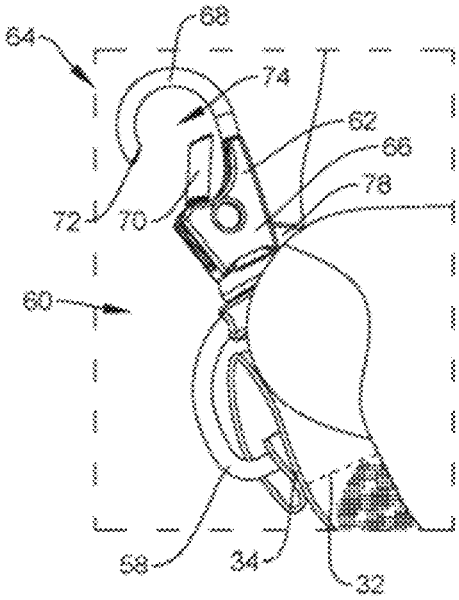
FIG. 7 illustrates components of the exemplary retaining system of FIG. 1.
Figure 8:
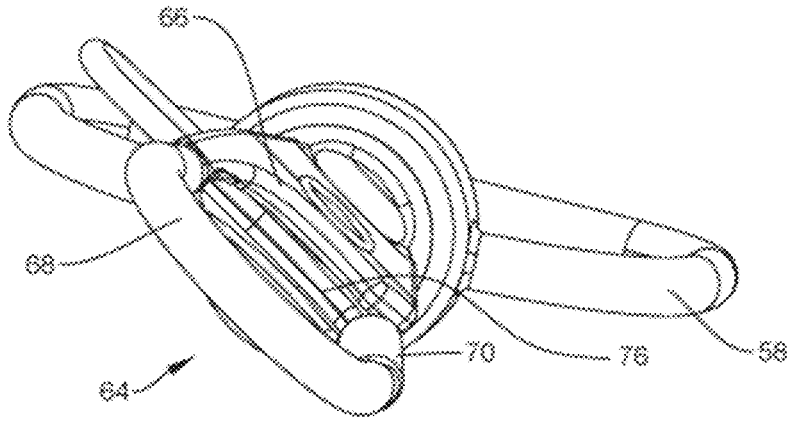
FIG. 8 illustrates components of the exemplary retaining system of FIG. 1.

A first portion 58 of a fastener 60 is positioned within hoop 52. A second portion 62 of fastener 60 is coupled to portion 58 such that portion 62 is rotatable relative to portion 58. Portion 62 comprises a hook, such as, for example, a snap hook 64. Snap hook 64 includes a body 66, a hook 68 extending from body 66 and a gate 70. Gate 70 is rotatable relative to body 66 and hook 68 via a lever 78. Gate 70 is movable between a first orientation in which gate 70 engages a tip 72 of hook 68, as shown in FIG. 6, and a second orientation in which gate 70 is spaced apart from tip 72, as shown in FIG. 7. A portion of an object, such as, for example, an article of footwear is configured to be inserted into a cavity 74 defined by inner surfaces of hook 68 and/or gate 70 when gate 70 is in the second orientation. Gate 70 is then moved from the second orientation to the first orientation to couple the article of footwear to fastener 60. In some embodiments, gate 70 is biased to the first orientation by a spring 76 positioned within body 66, as shown in FIG. 8. In some embodiments, fastener 60 is a trigger snap swivel hook. In some embodiments, tether 32 is adjustable in length to increase and/or decrease the distance between strap 22 and fastener 60. In some embodiments, tether 32 has a fixed length defined by the distance between strap 22 and fastener 60 and cannot be adjusted to increase and/or decrease the distance between strap 22 and fastener 60.

In operation and use, a child's foot is inserted through loop 28 and strap 22 is moved up the child's leg such that loop 28 encircles a portion of the child's leg. The child then inserts his or her foot into an article of footwear, such as, for example, a children's shoe 80 having a loop 82 such that at least a portion of the child's foot is positioned within shoe 80. If required, shoe 80 may be secured to the child's foot using shoelaces, for example. Shoe 80 is then coupled to fastener 60 by inserting loop 82 into cavity 74 when gate 70 is in the second orientation, shown in FIG. 7, and releasing lever 78 such that spring 76 causes gate 70 to move from the second orientation to the first orientation, shown in FIG. 6, thereby securing shoe 80 to fastener. 60. Because loop 28 is secured to the child's leg, shoe 80 will remain with the child even if shoe 80 is removed from the child's foot and hence prevent shoe 80 from being lost. That is, by simultaneously coupling shoe 80 and the child's leg to tether 32, shoe 80 will remain attached to the child, even if shoe 80 is removed from the child's foot.

In some embodiments, connector 36 is moved between the first orientation, shown in FIGS. 1 and 2, in which end 30 of tether 32 is connected to end 34 of tether 32 by connector 36, to the second orientation, shown in FIG. 3, in which end 30 is not connected to end 34 by connector 36. Shoe 80 can then be removed from the child's foot without removing strap 22 from the child's leg. Once shoe 80 is put back on the child's foot, shoe 80 can be reattached with tether 32 via fastener 60 in the manner discussed herein. Because strap 22 is still positioned around the child's leg, shoe 80 will remain with the child even if shoe 80 is removed from the child's foot.

It is envisioned that loop 28 may be positioned around the child's leg either before or after shoe 80 is coupled to tether 32 via fastener 60. It is envisioned that loop 28 may be positioned around the child's leg and/or shoe 80 is coupled to tether 32 via fastener 60 either before or after end 34 of tether 32 is connected with end 34 of tether 32 by connector 36. For example, in one embodiment, loop 28 may be positioned around the child's leg and shoe 80 is coupled to tether 32 via fastener 60 when end 40 of connector 36 is spaced apart from end 48 of connector 36, as shown in FIG. 3. After loop 28 is positioned around the child's leg and/or shoe 80 is coupled to tether 32 via fastener 60, end 40 of connector 36 engages end 48 of connector 36, as shown in FIG. 3.

Figure 9:
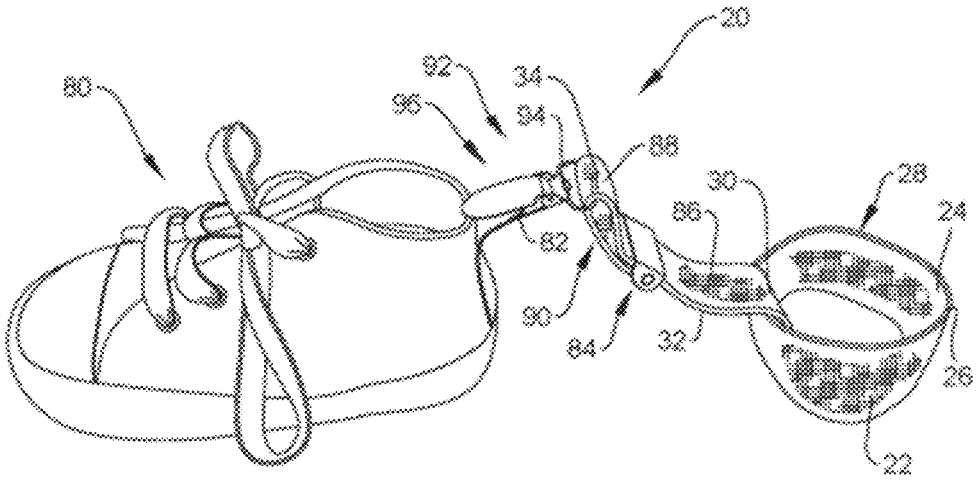
FIG. 9 illustrates another exemplary retaining system in accordance with the principles of the present disclosure.
Figure 9A:
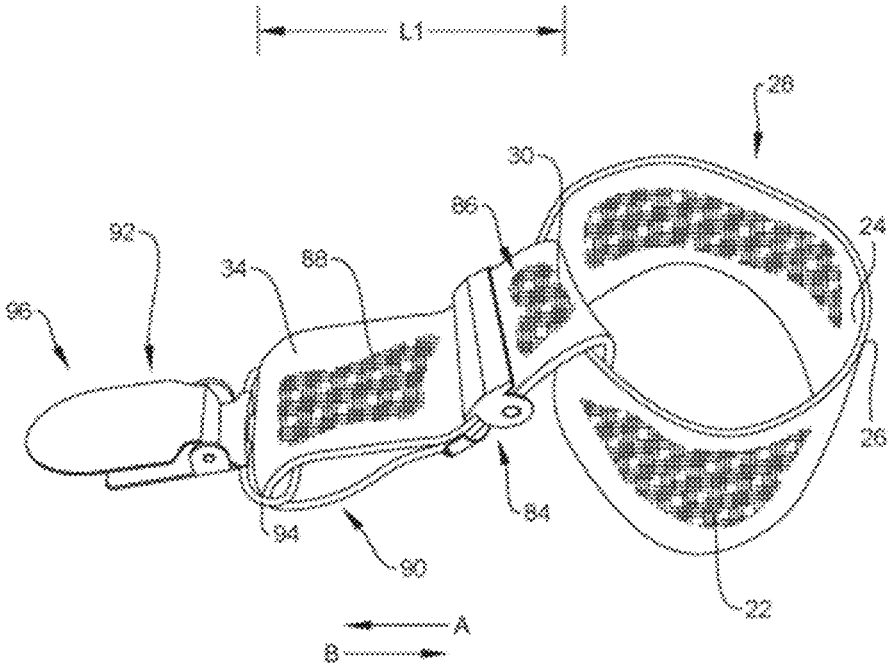
FIG. 9A illustrates components of the exemplary retaining system of FIG. 9.
Figure 9B:
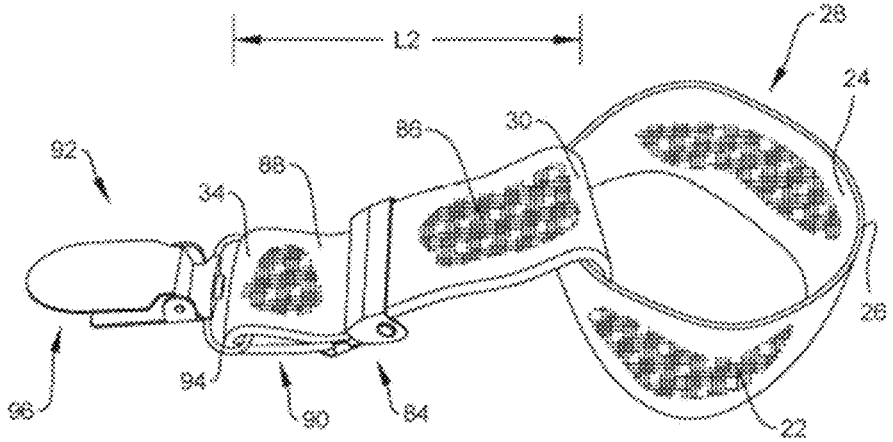
FIG. 9B illustrates components of the exemplary retaining system of FIG. 9.
Figure 10:
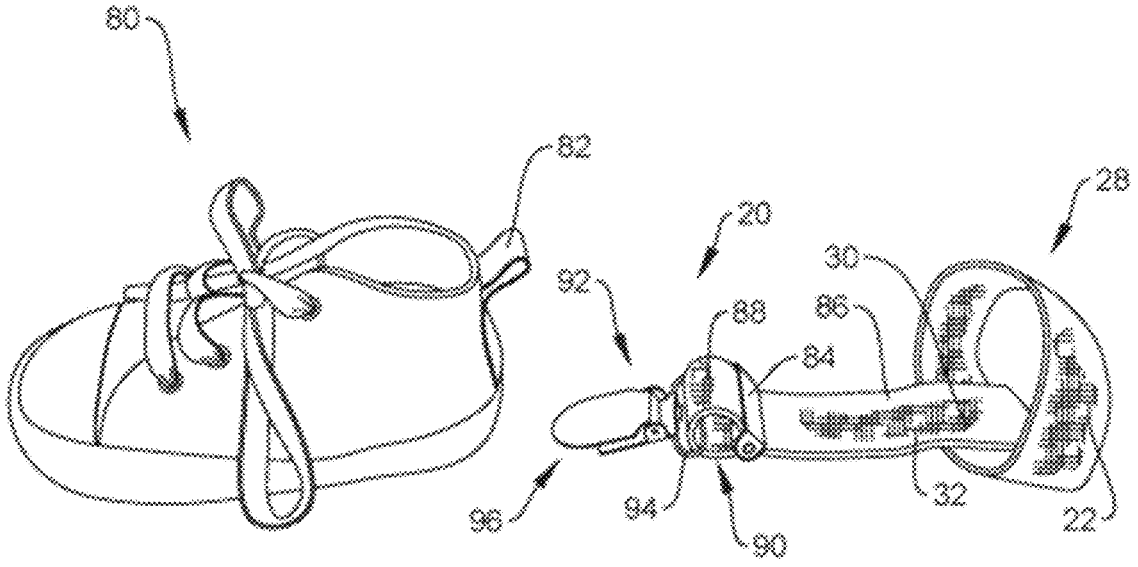
FIG. 10 illustrates components of the exemplary retaining system of FIG. 9.
Figure 11:
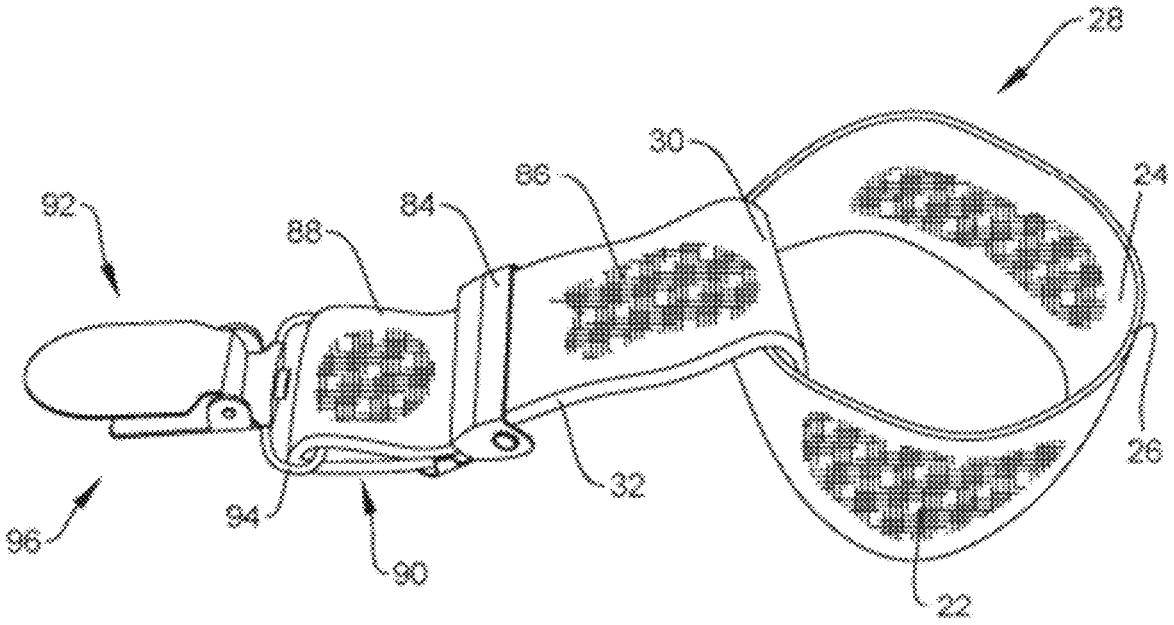
FIG. 11 illustrates components of the exemplary retaining system of FIG. 9.

In one embodiment, shown in FIGS. 9-13, tether 32 includes a slide 84 positioned between end 30 and end 34 in place of connector 36. Tether 32 further includes a portion 86 adjacent to end 30 that includes a single layer of material and a portion 88 adjacent to end 34 that includes a double layer of material to define a loop 90. Slide 84 is movable along tether 32 to increase and decrease the length of tether 32. For example, slide 84 is movable along tether 32 in the direction shown by arrow A in FIG. 9A to increase the length of tether 32 from length L1 to length L2, as shown in FIG. 9B. Likewise, slide 84 is movable along tether 32 in the direction shown by arrow B in FIG. 9A to decrease the length of tether 32 from length L2 to length L1. As shown in FIGS. 9A and 9B, the size of loop 90 is directly proportional to the length of tether 32. That is, as the length of tether 32 increases, the size of loop 90 decreases, and vice versa.

Figure 12:
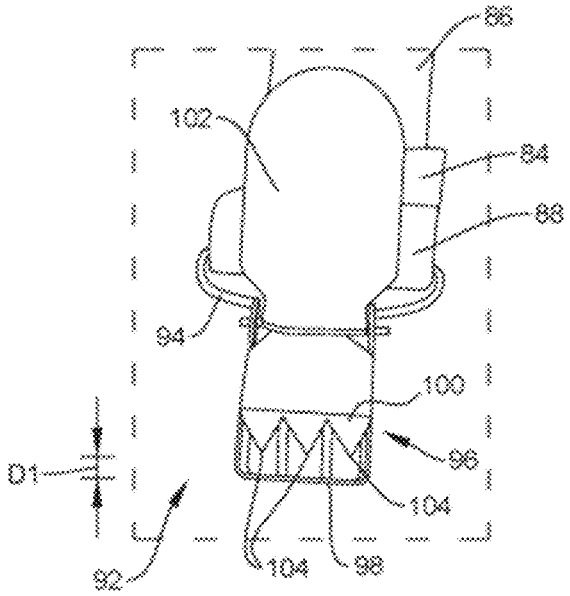
FIG. 12 illustrates components of the exemplary retaining system of FIG. 9.
Figure 13:
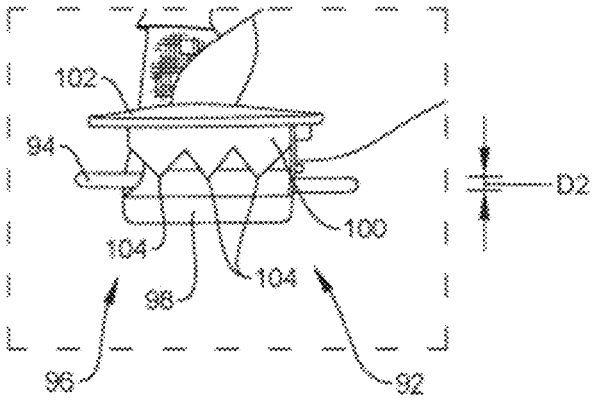
FIG. 13 illustrates components of the exemplary retaining system of FIG. 9.

End 34 of tether 32 is coupled to a fastener 92 that is similar to fastener 60. Fastener 92 includes a first portion 94 that is positioned within loop 90 and a second portion 96 that is coupled to portion 94 such that portion 96 is permanently fixed to portion 94. In some embodiments, portion 96 is integrally and/or monolithically formed with portion 94. Portion 96 comprises a body 98 and a clamp 100 that is rotatable relative to body 98 via a lever 102. In particular, lever 102 is rotatable relative to body 98 and clamp 100 to move fastener 92 between a first configuration in which lever 102 is spaced apart from clamp 100 and teeth 104 of clamp 100 are spaced a first distance D1 apart from body 98, as shown in FIG. 12, and a second configuration in which lever 102 engages clamp 100 and teeth 104 of clamp 100 are spaced a reduced second distance D2 apart from body 98, as shown in FIG. 13. Lever 102 maintains fastener 92 in the second configuration. That is, unless and until lever 102 is moved from the position shown in FIG. 13 to the position shown in FIG. 12, fastener 92 will remain in the second configuration. In some embodiments, fastener 92 is a suspender clip.

In operation and use, a child's foot is inserted through loop 28 and strap 22 is moved up the child's leg such that loop 28 encircles a portion of the child's leg. The child then inserts his or her foot into an article of footwear, such as, for example, shoe 80 such that at least a portion of the child's foot is positioned within shoe 80. If required, shoe 80 may be secured to the child's foot using shoelaces, for example. Shoe 80 is then coupled to fastener 92 by inserting loop 82 or another portion of shoe 80 between clamp 100 and body 98 when fastener 92 is in the first configuration shown in FIG. 12. Fastener 92 is then moved from the first configuration shown in FIG. 12 to the second configuration shown in FIG. 13 to secure loop 98 or another portion of shoe 80 between clamp 100 and body 98 such that shoe 80 is fixed to fastener 92. Because loop 28 is secured to the child's leg, shoe 80 will remain with the child even if shoe 80 is removed from the child's foot and hence prevent shoe 80 from being lost. That is, by simultaneously coupling shoe 80 and the child's leg to tether 32, shoe 80 will remain attached to the child, even if shoe 80 is removed from the child's foot.

Figure 14A:
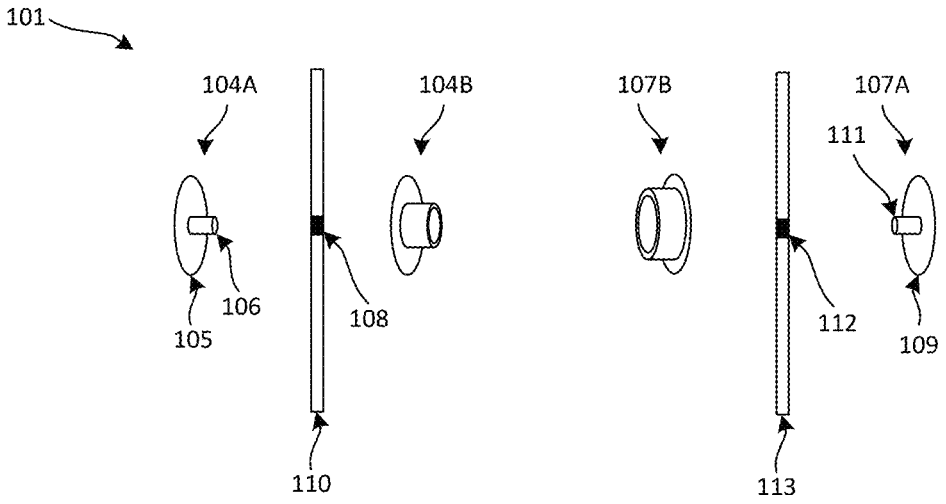
FIGS. 14A, 14B and 14C illustrate components of an exemplary press-snap connector.
Figure 14B:
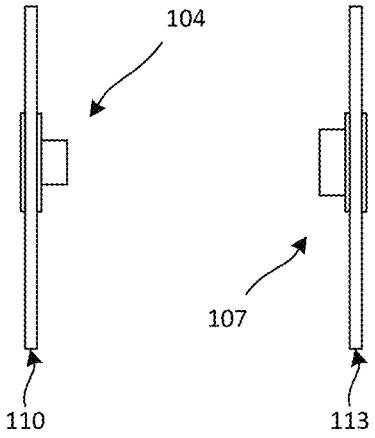
Figure 14C:
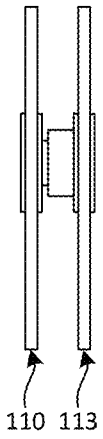

FIGS. 14A, 14B and 14C illustrate components of an exemplary press-snap fastener 101, configured to removably join two pieces of material together. As shown, the press-snap connector 101 includes an eyelet/stud portion 104 and a cap/socket portion 107. The eyelet/stud portion 104 can be installed on either side of a first material 110 (e.g., the eyelet 104A on one side and the stud 104B on the other side), and the cap/socket portion 107 can be installed on either side of a second material 113 (e.g., the cap 107A on one side and the socket 107B on the other side). Once installed, the first material 110 and second material 113 can be joined together by removably coupling the stud 104B and socket 107B.

The eyelet/stud portion 104 may include an eyelet 104A with a flange 105 and a post 106. The flange 105 may be configured to abut one side of the first material 110, and the post 106 may be configured to pass through a hole 108 in the material 110 and be received by the stud 104B. In some embodiments, a special tool is used to affix the eyelet 104A and stud 104B to either side of the material 110. Specifically, the tool may facilitate reshaping of the post 106 (which may comprise a metal or other material that, once shaped, holds its shape) such that the reshaped post 106 grips the stud 104B.

The cap/socket portion 107 may have a similar construction. That is, a cap 107A may also have a flange 109 configured to abut one side of another piece of material 113, and a post 111 configured to pass through a hole 112 in the material 113 and be received by the socket 107B. Again, a special tool may be used to reshape the post 111 in a manner that causes it to retain the socket 107B on the other side of the material 113.

Once the eyelet/stud portion 104 has been installed in the first material 110, and the cap/socket portion 107 has been installed in the second material 113, (e.g., as shown in FIG. 14B) the first material 110 and second material 113 may be removably joined together by engaging the stud 104B in the socket 107B (e.g., as shown in FIG. 14C). In some embodiments, the socket 107B includes a spring-loaded retention mechanism (not shown) that engages the stud (or, in some embodiments, a detent on the stud) until a sufficiently strong release force is applied to overcome the gripping force of the spring-loaded retention mechanism.

Figure 15:
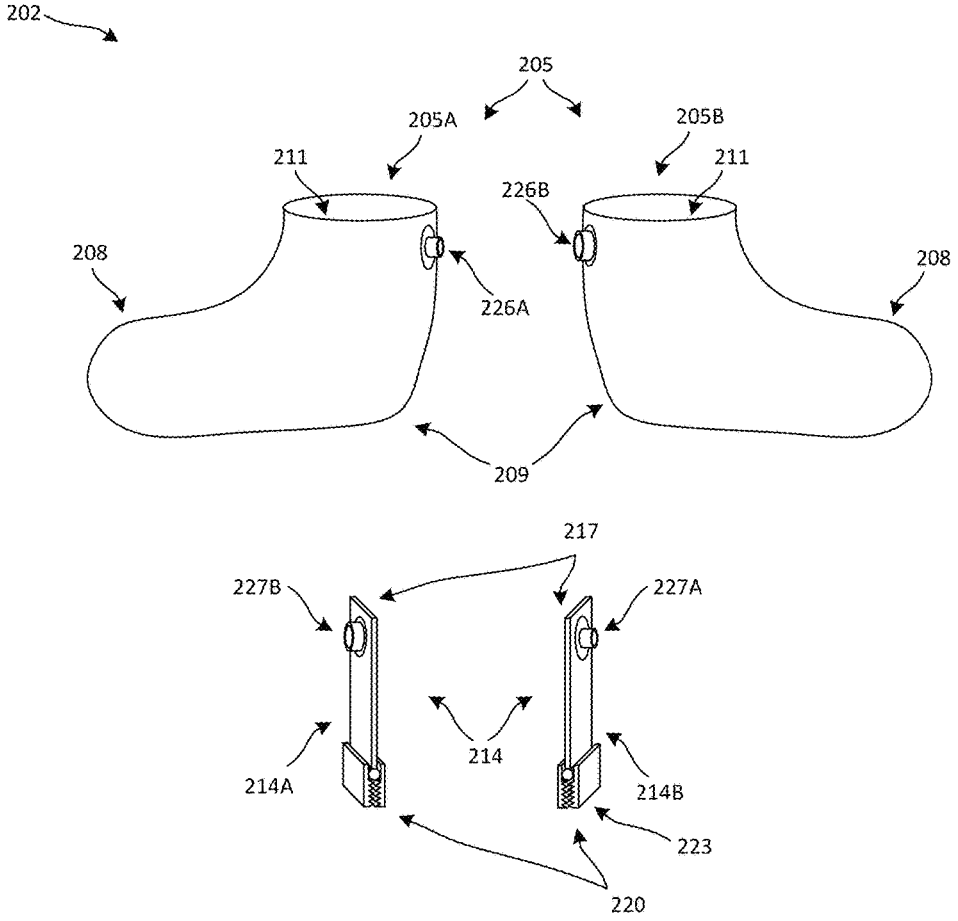
FIG. 15 illustrates an exemplary footwear ensemble.

FIG. 15 illustrates a footwear ensemble 202, in one embodiment. As shown, the footwear ensemble 202 includes a pair of socks 205, including a first sock 205A and a second sock 205B. Each of the first sock 205A and second sock 205B has a toe compartment 208 and a leg opening 211 opposite the toe compartment 208. In some embodiments, where the socks 205A and 205B are not merely cylindrical (e.g., tube socks) but rather include a bend or angle, a separately defined heel compartment 209 may also be present.

As shown, the footwear ensemble 202 also includes a pair of tethers 214, including a first tether 214A and a second tether 214B. Each of the first tether 214A and second tether 214B includes an anchor end 217 and a retention end 220. As shown, the retention end 220 of each tether 214A and 214B includes a shoe-retaining mechanism 223.

The footwear ensemble 202 further includes a pair of press-snap connectors, including a first pair 226A and 226B disposed on the pair of socks 205, and a second pair 227A and 227B disposed on the pair of tethers 214. In some embodiments, the press-snap connectors are configured as illustrated in and described with reference to FIGS. 14A, 14B and 14C—having an eyelet/stud portion 226A and 227A and a cap/socket portion 226B and 227B that can be removably coupled together. Moreover, the press-snap connectors may be interchangeable; that is, the eyelet/stud portion 226A of the first pair may be removably coupled with either the cap/socket portion 226B of the first pair or the cap/socket portion 227B of the second pair.

In some embodiments, the eyelet/stud portion 226A of the first pair of press-snap connectors is disposed on the first sock 205A, the cap/socket portion 226B of the first pair of press-snap connectors is disposed on the second sock 205B, the eyelet/stud portion 227A of the second pair of press-snap connectors is disposed on the second tether 214B, and the cap/socket portion 227B of the second pair of press-snap connectors is disposed on the first tether 214A. In embodiments, the press-snap connectors 226A and 227A are interchangeable, and the press-snap connectors 226B and 227B are interchangeable. Such an arrangement can facilitate coupling of the first sock 205A to the second sock 205B, the first tether 214A to the second tether 214B, the first tether 214A to the first sock 205A, or the second tether 214B to the second sock 205B.

In some embodiments, the shoe-retaining mechanism 220 is a spring-loaded clip (e.g., an "alligator" or jaw-style clip). The shoe-retaining mechanism may be designed to open sufficiently to accommodate small shoes, such as those that would be worn by an infant or toddler. In some embodiments, the shoe-retaining mechanism 220 is configured to be flat or slightly contoured on at least one side, such that it can lay flat or follow a natural contour of an infant or toddler's heel.

Figure 16A:
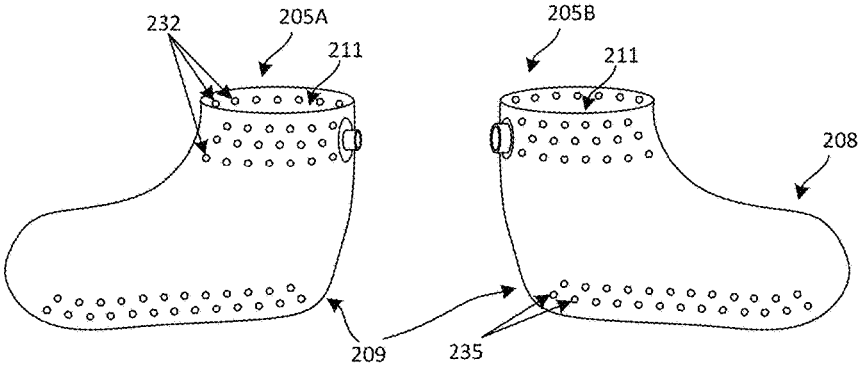
FIGS. 16A and 16B illustrate additional aspects of an exemplary footwear ensemble.
Figure 16B:
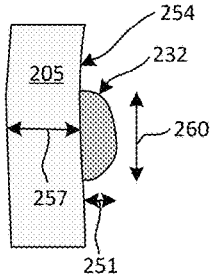

Referring to FIG. 16A, each of the first sock 205A and second sock 205B may include a plurality of nubs 232 on an interior surface, adjacent the leg openings 211. In some embodiments, as shown, the nubs 232 may extend through the material of the socks 205A and 205B, such that the nubs 232 are exposed on both the interior and exterior of the socks 205A and 205B. In some embodiments (see FIG. 16B), the nubs 232 may be disposed only on an interior surface of the socks 205A and 205B.

The nubs 232 may be configured to have a higher coefficient of friction with skin relative to the coefficient of friction between the socks 205A and 205B and skin. In this manner, the nubs 232 may have the effect of helping to retain the socks 205A and 205B on the feet of their wearer. Moreover, when the socks 205A and 205B and tethers 214A and 214B are employed to help retain footwear of an infant or toddler (see FIG. 17), the nubs 232 may have the effect of providing additional "gripping strength" to retain the footwear.

In some embodiments, the coefficient of friction (e.g., coefficient of static friction, or coefficient of kinetic friction, or both) of the nubs 232 is greater than the coefficient of friction of the material of the socks 205A and 205B. In some embodiments, coefficient of friction is measured as a ratio of the frictional force resisting the motion of two surfaces in contact to the normal (perpendicular) force pressing the two surfaces together. In some embodiments, the coefficient of friction for exemplary socks may be in the range of 0.31 to 0.41, or 0.25 to 0.31, or 0.37 to 0.60 or 0.42 to 0.52; or a coefficient of friction for exemplary socks may have an average of about 0.45 (as used herein, "about" may mean within 1%, 5%, 10%, 25% or 50% of a nominal value.) In contrast, an exemplary coefficient of friction for the nubs 232 may be in the range of 0.47 to 0.90; or a coefficient of friction for exemplary nubs 232 may have an average of about 0.70. In some embodiments, the average coefficient of friction of the nubs 232 exceeds that of the socks 205A and 205B by 10%, 25%, 50%, 100%, 150%, 200%, 500% or 1000%.

In some embodiments, the nubs 232 comprise a silicone material (e.g., silicone, silicone free of polyvinyl chloride (PVC-free silicone), silicone gel). In other embodiments, the nubs 232 comprise another material (e.g., puffy paint, rubber, foamed rubber, synthetic resin materials (urethane resin, silicone resin, acrylic resin, etc.)) that is suitable for prolonged contact with human skin without causing irritation. The material itself may be chemically stable such that it is appropriate for prolonged contact with skin.

Moreover, the dimensions of the nubs 232 may be configured such that they do not dig in too deeply into the skin in which they are in contact, when the socks 205A and 205B are worn by an infant or toddler, and such that the diameter or area of the nubs 232 does not significantly impede circulation, perspiration, or evaporation of perspiration. For example, referring to FIG. 16B, in some embodiments, the nubs 232 extend to a distance 251 that is no farther beyond an interior surface 254 of a sock 205 than some fraction of the thickness 257 of the material itself (e.g., 10%, 25%, 50%, 100%). In some embodiments, the nubs 232 have a diameter 260 of no more than about 2 millimeters, 3 millimeters, 5 millimeters or 10 millimeters.

In some embodiments, the socks 205A and 205B may comprise a second plurality of nubs 235 on the bottom of the toe compartment 208 (and heel compartment 209, if present). The second plurality of nubs 235 may be similarly configured as the nubs 232—that is, the second plurality of nubs 235 may also comprise a material that is appropriate for prolonged contact with skin and that increases (relative to the socks 205A and 205B themselves) the coefficient of friction with adjacent skin and/or with an inside surface of footwear, when the socks 205A and 205B and such footwear are worn. In such embodiments, the second plurality of nubs 235 may provide further "gripping strength" with the bottom of a wearer's foot.

Figure 17:
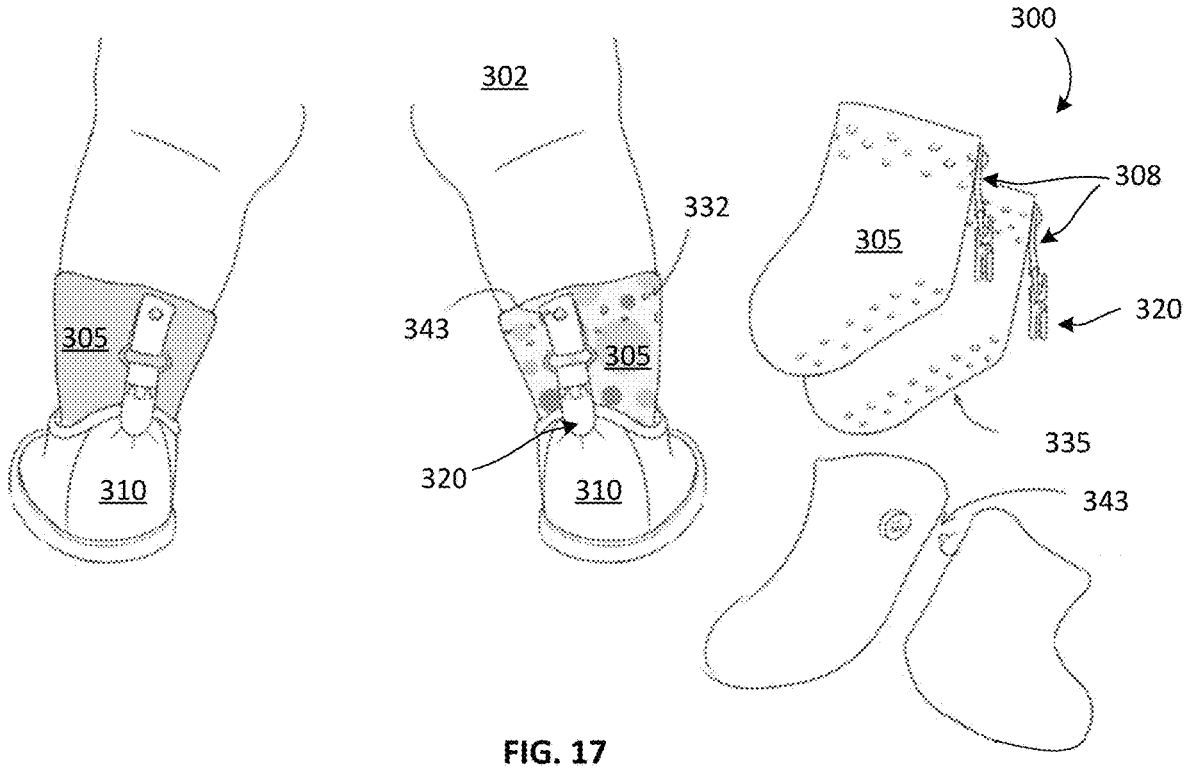
FIG. 17 illustrates another exemplary footwear ensemble.
Figure 18:
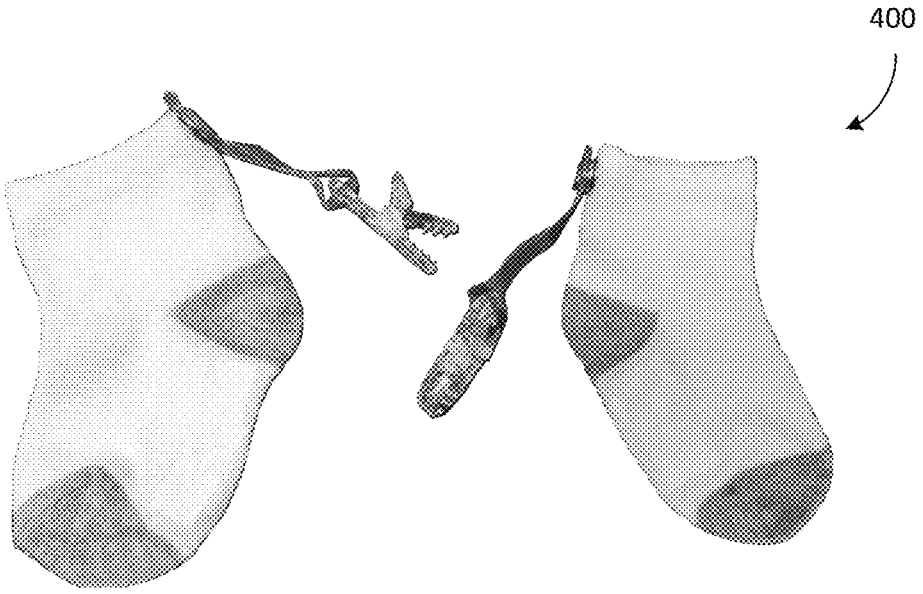
FIG. 18 illustrates another exemplary footwear ensemble.

FIG. 17 illustrates an exemplary footwear retention system 300, in use by a wearer 302. In particular, as shown, the system 300 includes a pair of socks 305 and tethers 308. The tethers 308 may be affixed to the socks 305 with a press-snap connector 343, and the tethers may grip footwear 310 (e.g., moccasins, a pair of shoes, etc.) with a retention mechanism 320, such as a jaw-style grip. FIG. 18 illustrates another exemplary footwear retention system 400.

While several embodiments have been described with reference to exemplary aspects, it will be understood by those skilled in the art that various changes may be made and equivalents may be substituted for elements thereof without departing from the contemplated scope. For example, retention mechanisms may comprise designs other than jaw-style grips—such as, for example, a hook-and-loop fastener system, a clasp and eyelet, a press-snap connector, etc. Similar other systems could be used in place of press-snap connectors. Press-snap connectors could take other forms than are described herein. Various materials could be employed for nubs. Structures or designs other than nubs may be employed to create regions of increased coefficients of friction. In addition, many modifications may be made to adapt a particular situation or material to the teachings provided herein without departing from the essential scope thereof. Therefore, it is not intended that the scope be limited to the particular aspects or embodiments disclosed; rather, the scope includes all aspects falling within the appended claims.

What is claimed is:

1. A footwear ensemble comprising:

a pair of socks comprising a first sock and a second sock, each of the first sock and second sock having a toe compartment and a leg opening opposite the toe compartment;

a plurality of nubs disposed on an interior surface of the first sock adjacent its leg opening and on an interior surface of the second sock adjacent its leg opening;

a pair of press-snap fasteners comprising a first press-snap connector and a second press-snap connector, each of the first press-snap connector and second press-snap connector being interchangeable and comprising a cap/socket portion and a stud/eyelet portion; and a pair of tethers comprising a first tether and a second tether, each of the first tether and second tether comprising an anchor end and a retention end, wherein the retention end comprises a shoe-retaining mechanism;

wherein the cap/socket portion of the first press-snap connector is disposed on the first sock adjacent its leg opening, the stud/eyelet portion of the first press-snap connector is disposed on the second sock adjacent its leg opening, the stud/eyelet portion of the second press-snap connector is disposed on the first tether at its anchor end, and the cap/socket portion of the second press-snap connector is disposed on the second tether at its anchor end.

2. The footwear ensemble of claim 1, wherein the plurality of nubs comprises silicone nubs.

3. The footwear ensemble of claim 1, wherein each nub in the plurality of nubs has a diameter that is less than 10 millimeters.

4. The footwear ensemble of claim 1, wherein each nub in the plurality of nubs extends no farther beyond an interior surface of a sock than 200% of a thickness of either sock in the pair of socks.

5. The footwear ensemble of claim 1, wherein a coefficient of friction of a nub in the plurality of nubs is at least 50% greater than a coefficient of friction of a material comprising the pair of socks.

6. The footwear ensemble of claim 1, wherein the first sock and second sock each further comprise a heel compartment between the leg opening and the toe compartment.

7. The footwear ensemble of claim 6, further comprising a second plurality of nubs comprising the same material as the plurality of nubs and being disposed on bottom portions of the toe compartment and heel compartment.

8. The footwear ensemble of claim 1, further comprising a pair of shoes having a first shoe and a second shoe.

9. The footwear ensemble of claim 8, wherein the shoe-retaining mechanism is configured to releasably secure a tether from the first tether or second tether to a shoe from the first shoe or second shoe.

10. A footwear ensemble comprising:

a pair of socks comprising a first sock and a second sock, each of the first sock and second sock having a toe compartment and a leg opening opposite the toe compartment;

a pair of press-snap fasteners comprising a first press-snap connector and a second press-snap connector, each of the first press-snap connector and second press-snap connector being interchangeable and comprising a cap/socket portion and a stud/eyelet portion; and a pair of tethers comprising a first tether and a second tether, each of the first tether and second tether comprising an anchor end and a retention end, wherein the retention end comprises a shoe-retaining mechanism;

wherein the cap/socket portion of the first press-snap connector is disposed on the first sock adjacent its leg opening, the stud/eyelet portion of the first press-snap connector is disposed on the second sock adjacent its leg opening, the cap/socket portion of the second press-snap connector is disposed on the second tether at its anchor end, and the stud/eyelet portion of the second press-snap connector is disposed on the first tether at its anchor end.

11. The footwear ensemble of claim 10, wherein the pair of press-snap connectors are disposed on the first sock, second sock, first tether, and second tether to facilitate joining the first sock and second sock, the first tether and second tether, the first tether and first sock, or the second tether and second sock.

12. The footwear ensemble of claim 10, wherein the shoe-retaining mechanism comprises a spring-loaded jaw clip.

13. The footwear ensemble of claim 10, wherein the shoe-retaining mechanism comprises a clasp and loop.

14. The footwear ensemble of claim 10, wherein the first sock and second sock each comprise a plurality of nubs on an interior surface, adjacent their respective leg openings.

15. The footwear ensemble of claim 14, wherein the plurality of nubs comprises silicone, rubber, foamed rubber or a synthetic resin.

16. The footwear ensemble of claim 14, wherein each nub in the plurality of nubs extends no farther beyond an interior surface of a sock than 200% of a thickness of either sock in the pair of socks.

17. The footwear ensemble of claim 10, wherein the first sock and second sock each further comprise a heel compartment between the leg opening and the toe compartment.

18. The footwear ensemble of claim 17, further comprising a second plurality of nubs comprising the same material as the plurality of nubs and being disposed on bottom portions of the toe compartment and heel compartment.

19. The footwear ensemble of claim 10, further comprising a pair of shoes.

20. A footwear ensemble comprising:

a pair of socks comprising a first sock and a second sock, each of the first sock and second sock having a toe compartment and a leg opening opposite the toe compartment;

a pair of press-snap fasteners comprising a first press-snap connector and a second press-snap connector, each of the first press-snap connector and second press-snap connector being interchangeable and comprising a cap/socket portion and a stud/eyelet portion;

a pair of shoes comprising a first shoe and a second shoe; and a pair of tethers comprising a first tether and a second tether, each of the first tether and second tether comprising an anchor end and a retention end, wherein the retention end comprises a shoe-retaining mechanism, the shoe-retaining mechanism configured to releasably secure either the first shoe or the second shoe;

wherein the cap/socket portion of the first press-snap connector is disposed on the first sock adjacent its leg opening, the stud/eyelet portion of the first press-snap connector is disposed on the second sock adjacent its leg opening, the cap/socket portion of the second press-snap connector is disposed on the second tether at its anchor end, and the stud/eyelet portion of the second press-snap connector is disposed on the first tether at its anchor end.

* * * * *